United States Patent [19]

Addicks

[11] Patent Number: 4,841,288

[45] Date of Patent: Jun. 20, 1989

[54] EARTHQUAKE ILLUMINATING DEVICE

[76] Inventor: Lyle F. Addicks, 10246 S. Julius Ave., Downey, Calif. 90241

[21] Appl. No.: 158,635

[22] Filed: Feb. 22, 1988

[51] Int. Cl.[4] ..... G08B 21/00

[52] U.S. Cl. ..... 340/690; 200/61.49; 340/321; 340/693

[58] Field of Search ..... 340/690, 669, 566, 693, 340/321, 662; 73/654, 652, 651; 200/61.45 R, 61.49; 307/121; 181/122

[56] References Cited

U.S. PATENT DOCUMENTS

| | | | |
|---|---|---|---|
| 3,924,254 | 12/1975 | Klebold et al. | 200/61.49 X |
| 4,214,238 | 7/1980 | Adams et al. | 340/690 |
| 4,297,690 | 10/1981 | Baker | 340/690 |

*Primary Examiner*—Glen R. Swann, III
*Assistant Examiner*—Thomas J. Mullen, Jr.
*Attorney, Agent, or Firm*—John T. Matlago

[57] ABSTRACT

An illuminating device comprises a housing having a light compartment and an off push-button located on the front wall thereof. The housing encloses a battery powered electrical circuit including a normally-open motion detection switch, a light bulb, a latching circuit, a control gate, and a normally open, momentary-closing reset switch. The housing is adapted to be removably fastened at a convenient location on an internal wall of a home. When the wall is shaken by a major earthquake that is likely to knock out the electric service in the area involved, the initial closing of the motion detection switch latches the latching circuit to provide a high level signal that opens the control gate and completes the electrical circuit to ground, thereby turning on the light bulb. When the earthquake occurs during the night time, the housing can be removed from the wall and used as a portable flashlight. Once turned on, the light bulb can be turned off by manually depressing the off push-button which momentarily closes the reset switch and thereby unlatches the latching circuit.

8 Claims, 2 Drawing Sheets

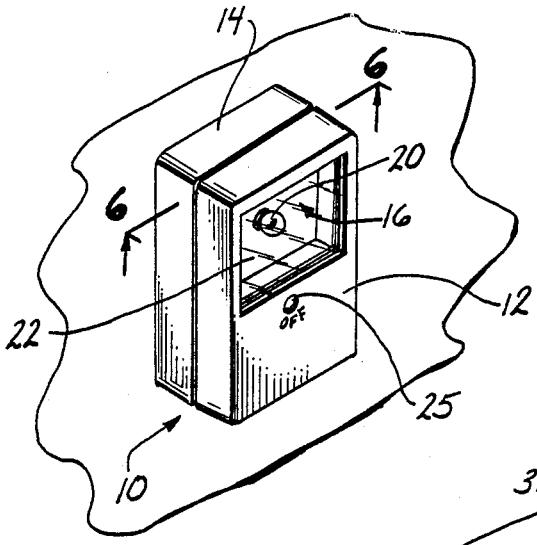
FIG. 1
FIG. 2
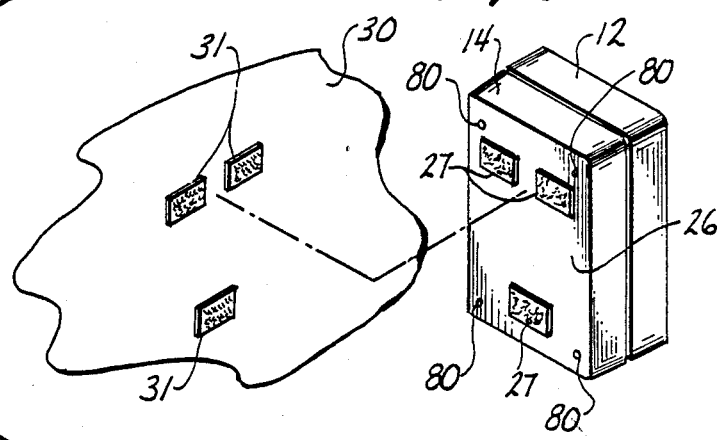
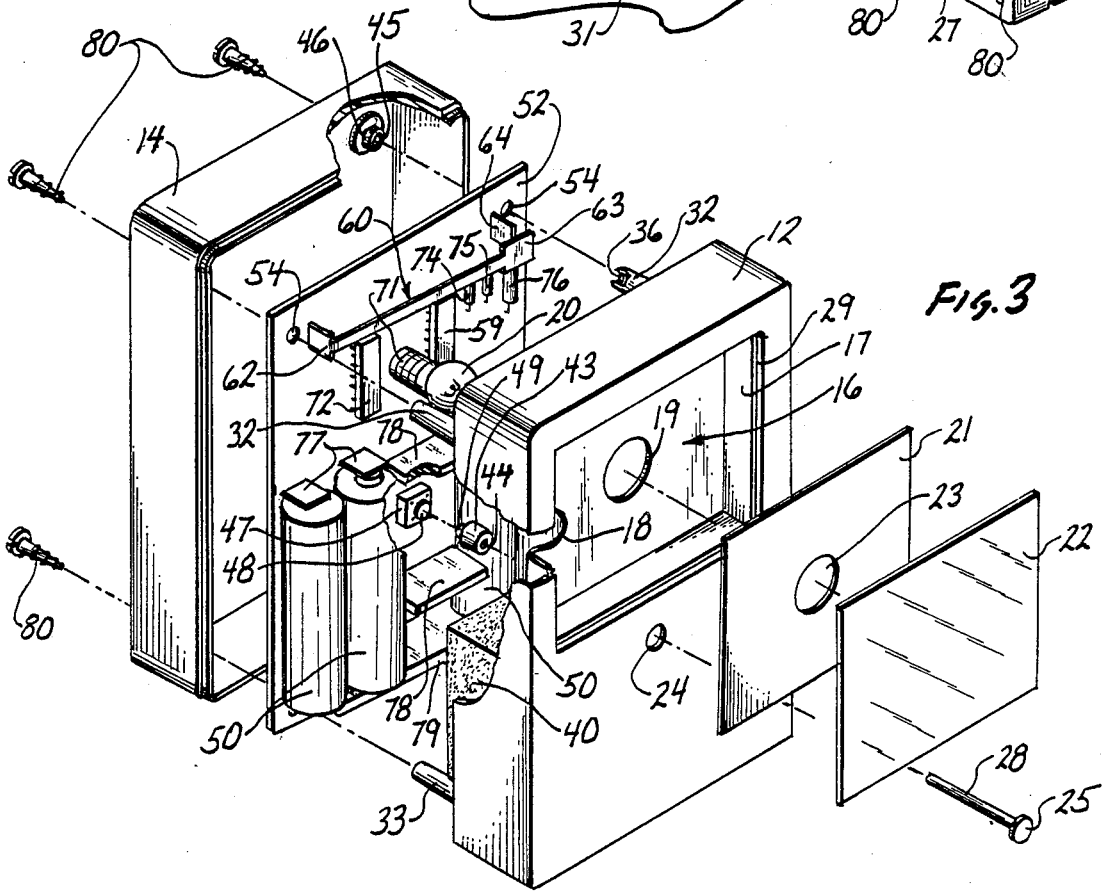
FIG. 3

EARTHQUAKE ILLUMINATING DEVICE

BACKGROUND OF THE INVENTION

This invention relates to illuminating apparatus and more particularly to an illuminating device which is mounted on a wall in a home and is set to turn on when the wall is shaken by a major earthquake.

The southwest area of the U.S. and especially the central and southern parts of the state of California are subject to earthquakes. When these earthquakes are strong enough they can cause significant damage including knocking out the electrical power for the areas involved. Thus, in order to prepare for such severe earthquakes that may occur during the night time, it has been recommended by community leaders that residents of these areas should make sure that they always have flashlights with good batteries available in their homes.

Now it is well known that the damage that can be caused by strong earthquakes on home structures can include knocking over floor lamps and causing pictures hanging on walls, and other objects sitting on tables or shelves, to fall onto the floor, thus creating a hazard if one attempts to move about the home in the dark in order to obtain a flashlight which generally is stored in an out of the way drawer or cupboard. Moreover, it often happens that, at any given time, the batteries in a flashlight in a home are likely to be dead since the chances are that they have not been checked for a long period of time.

SUMMARY OF THE INVENTION

In accordance with the present invention, a housing for an earthquake illuminating device is molded to provide front and rear half housing sections which can be mated together. The front half housing section is formed with a light compartment enclosing a light bulb on the upper half thereof and an off push-button located on the front wall thereof. The rear half housing section encloses a printed circuit board which has components of an electrical circuit mounted thereon for controlling the light bulb. These components include battery cells, an elongated socket for the light bulb, a normally-open motion detection switch, a latching circuit, a control gate and a normally-open, momentarily-closing, reset switch. Fastening means are provided for detachably securing the housing to a convenient location on the inner wall of a home. When the wall is shaken by a major earthquake that may be severe enough to knock-out the electric power in the area, the first closing of the detection switch latches the latching circuit and opens the control gate. This completes the connecting of the electrical circuit to ground, thereby turning on the light bulb.

Accordingly, one of the objects of the present invention is to provide for detachably mounting an illuminating device enclosing an electrical circuit including a light bulb and a motion detection switch on the internal wall of a home whereby when a major earthquake hits, the motion detection switch responds to the shaking of the home to turn on the light bulb.

Another object of the present invention is to provide an illuminating device that is securely held onto a wall of a home during an earthquake but yet can be readily removed from the wall when desired for use as a portable flashlight when the earthquake hits during the night time.

Yet, another object of the present invention is to provide an illuminating device that can be mounted in a convenient and readily accessible location on the internal wall of a home whereby, from time to time, the wall can be purposely thumped by hand to turn on the device, thereby assuring that the batteries therein are still in working condition.

With these and other objects in view, the invention consists of the construction, arrangement and combination of the various parts of the device, whereby the objects contemplated are attained as hereinafter set forth, pointed out in the appended claims, and illustrated in the accompanying drawings.

BRIEF DESCRIPTION OF THE DRAWINGS

FIG. 1 is a front perspective view of the illuminating device of the present invention;

FIG. 2 is a back perspective view of the illuminating device showing how it is mounted on a wall in a home;

FIG. 3 is an exploded view showing the parts of the illuminating device;

DETAILED DESCRIPTION OF THE INVENTION

Figure 5:
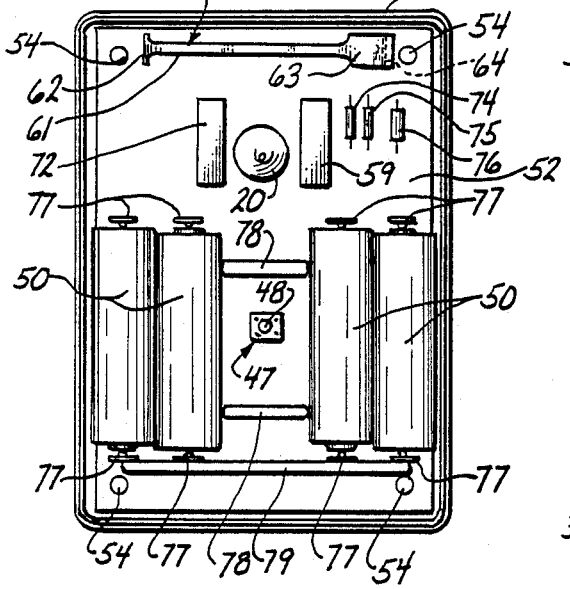
FIG. 5 is a view of the front of the assembled rear half housing section showing the printed circuit board with the components of the electrical circuit for the device mounted thereon.

Reference will first be made to FIG. 1 showing the assembled earthquake illuminating device 10 of the present invention. The device 10 includes a rectangular front half housing section 12 and a mating rectangular rear half housing section 14. The front half housing section 12 has integrally molded within the upper half thereof a light compartment 16 having a light bulb 20 mounted in an opening in the center of the back wall thereof and a styrene diffusing lens 22 covering the front opening thereof. In addition, an off push-button 25 is located on the front wall of the front half housing section 12 below the light compartment 16.

The housing of illuminating device 10 is adapted to be detachably fastened to the internal wall of a home by Velcro (registered trademark) fasteners. These fasteners consist of two differently woven structure parts which interengage when pressed together and separate when pulled apart. Thus, as shown in FIG. 2, the back surface 26 of the rear half housing section 14 of device 10 has secured thereon by adhesive three fastener pads 27 of one woven structure, two of the pads 27 being spaced apart on the top portion thereof and one of the pads 27 being located on the central bottom portion thereof. An internal wall 30 of a home in which the housing of the illuminating device 10 is to be mounted has secured thereon by adhesive three correspondingly shaped and located interengaging fastener pads 31 of the other structure.

By use of the interengaging fastener pads 27 and 31, the device 10 can be securely mounted on the wall 30 while enabling it to be readily removed therefrom in the event that the light bulb 20 is turned on by a major earthquake that occurs during the night time when the electric power in the home fails, thereby enabling it to be used as a portable flashlight.

As best illustrated in FIG. 3, which shows an exploded view of the parts of the illuminating device 10, the light compartment 16 on the upper interior of the front half housing section 12 is provided with a central circular opening 19 on the back wall 18 thereof for receiving the light bulb 20. A sheet of silver mylar reflector 21 having an opening 23 therein corresponding to that of circular opening 19 is secured by adhesive on the front surface of back wall 18. The styrene diffusing lens 22 is seated with its edges press fit in a recess 29 provided on the front wall about the rectangular opening 17 of compartment 16. An integrally molded support rod 32 extends rearwardly from each of the two upper corners of the light compartment 16 within front half housing section 12 and an integrally molded support rod 33 extends rearwardly from each of the two lower interior corners of the front half housing section 12. The end portion of each of the support rods 32 and 33 is hollow and provided with internal threads 36 for receiving screws 80 used to hold the half housing sections 12 and 14 together.

Figure 4:
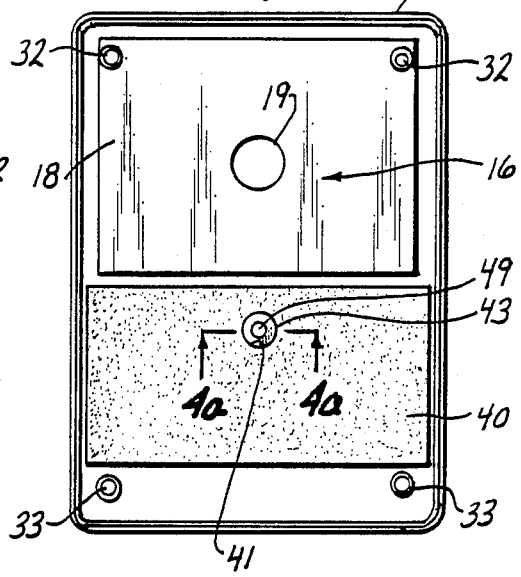
FIG. 4 is a view of the back of the assembled front half housing section for the illuminating device.
Figure 4A:
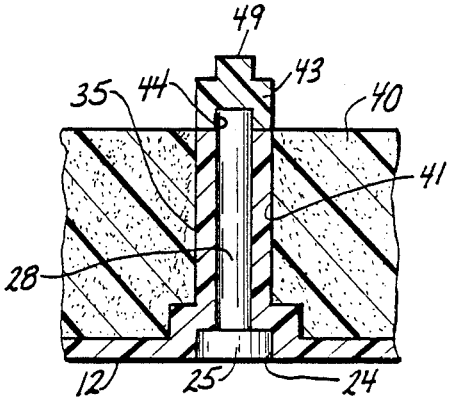
FIG. 4*a* is an enlarged sectional view as taken along lines 4*a*–4*a* of FIG. 4.

As best shown in FIGS 4 and 4*a*, integrally molded to extend rearwardly of the front wall of the front half housing section 12 is a tubular guide 35 having its axis in alignment with the axis of the circular recessed opening 24 provided on the front wall. A rectangular block of foam cushion 40 having a hole 41 which fits fairly snugly over the tubular guide 35 is located within the lower interior of the front half housing section 12 below the light compartment 16. As will be described hereinafter, the block of foam cushion 40 is being used for bearing against the battery cells 50 and thereby holding them in position within the back half housing section 14 in the event the illuminating device 10 is jolted during an earthquake.

As shown in FIG. 4*a*, in the assembly of the front housing section 12, a pin 28 integrally formed to extend from the back of the push-button 25 is inserted from the front of the half housing section 12 into the circular recessed opening 24 and slideably through the tubular guide 35 such that the push-button 25 is loosely seated in the circular recessed opening 24 and the end of the pin 28 extends out beyond the outer end of tubular guide 35 and also the outer surface of the block of foam cushion 40. An adapter 43 having a recessed hole 44 on the front end thereof fits over the extended outer end of the pin 28.

Figure 6:
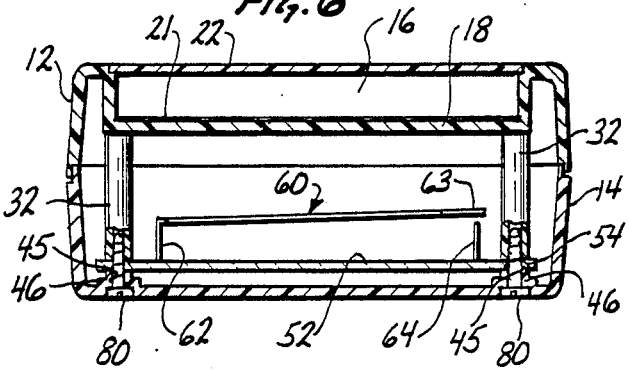
FIG. 6 is an enlarged sectional view of the assembled illuminating device as taken along lines 6—6 of FIG. 1.

As shown in FIGS. 3 and 6, the back wall of the rear half housing section 14 is provided with holes 45 at each of its corners having the washer-like portions 46 molded on the interior corner surfaces thereof.

Reference will next be made to the printed circuit board 52 shown in FIG. 5 mounted within the rear half housing section 14. The circuit board 52 has components of the electrical circuit for the illuminating device 10 mounted on the front surface thereof and printed circuit paths (not shown) fabricated on the rear surfaces thereof for connecting the components in accordance with the schematic electrical diagram shown in FIG. 7, to be hereinafter described. As illustrated in FIG. 5, a motion detection switch 60 is mounted on the upper end of circuit board 52. The motion detection switch is made of brass and comprises a horizontally disposed thin strip 61 having a fixed end 62 and a free end 63 which is widened so as to increase its weight. The fixed end 62 is bent at substantially a right angle to the thin strip 61 and provided with terminals that extend through holes in the circuit board 52. The weighted free end 63 is set to be spaced a controlled predetermined distance from a fixed contact 64 having terminals that extend through holes in the circuit board 52.

Located on the front surface of the circuit board 52, just below the motion detection switch 60 is a first integrated circuit unit incorporating a latching circuit 59, an elongated socket 71 (FIG. 3) for carrying the light bulb 20, and a second integrated circuit unit incorporating a control gate 72. Also shown are resistors 74 and 75 and a diode 76. In addition, a normally-open reset switch 47, provided with a contact having a spring loaded projection 48, is located in the middle of the lower half of the circuit board 52 so as to be aligned with the tubular guide 35 provided on the back of the front wall of half housing section 12 (FIG. 4*a*). Each of these components has terminals that extend through holes in the circuit board 52 and are soldered to the printed circuit paths provided on the opposite side of the circuit board.

The power for the electrical circuit of the earthquake light bulb 32 is provided by four 1.5 volt battery cells 50. Two of the battery cells 50 are located on each side of the front surface of the circuit board 52. Each cell 50 is snap fitted between an opposing pair of spring steel leaf contacts 77 having terminals extending through holes in the printed circuit board 52 and soldered to the printed circuit paths provided on the opposite side thereof. In addition, a pair of plastic molded central separators 78 and a plastic molded end support 79 are attached to the circuit board to help hold the battery cells 50 securely in position within the rear half housing section 14 during the jolting that the device 10 receives during an earthquake.

To assemble the earthquake illuminating device 10, the printed circuit board 52 with the components mounted thereon is positioned within the interior of the rear half housing section 14 (FIG. 5) with its corner openings 54 resting against and aligned with the corner holes 45 on the molded corner washer-like portions 46 (FIG. 6). The front half housing section 12 with the block of foam cushion 40 positioned therein, as shown in FIG. 4, is then mated with the rear half housing section 14. As a result, the ends of the upper and lower corner support rods 32 and 33 are positioned to contact the respective upper and lower corner surfaces of the printed circuit board 52 such that their threaded end bores 36 are in alignment with the corner holes 54 on the printed circuit board 52 and, therefore, the corner holes 46 extending through the back wall of the rear half housing section 14. Upon so assembling the front and rear half housing sections, the light bulb 20 held on the elongated socket 71 mounted on the front surface of the printed circuit board 52 is positioned to extend through the circular hole 19 in the back wall of the light compartment 16. Moreover, the pin 28, which is slideably positioned through the tubular guide 35 and carries the push-button 25 on the front thereof, locates the projecting rear end 49 of adaptor 43, that is positioned on the rear thereof, such that the projecting end 49 just touches the spring loaded projection 48 provided on the contact of reset switch 47. Screws 80 are then inserted through each of the corner holes 45 on the back of the rear half housing section 14 and engage with the internal threads 36 provided on each of the corner support rods 32 and 33, thus holding the half housing sections 12 and 14 together.

Reference will next be made to the electrical schematic diagram of the circuit in FIG. 7 which shows how the components, mounted on the front surface of the printed circuit board 52 with their terminals passing through holes in the circuit board, are interconnected by the printed circuit paths fabricated on the back surface thereof.

Figure 7:
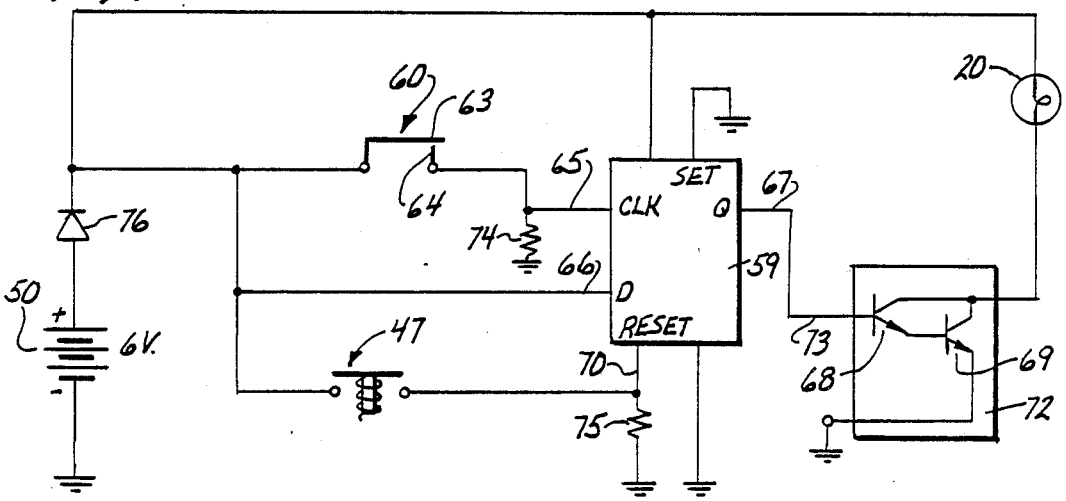
FIG. 7 is a schematic diagram of the electrical circuit for the illuminating device as fabricated on the printed circuit board.

As shown in FIG. 7, the series of four 1.5 volt battery cells 50 provide 6 volts of power to the circuit. The diode 76 is provided to ensure that current will flow in only one direction so that the circuit components will not be damaged in the event that the terminals of the battery cells 50 should be placed incorrectly between the leaf springs 77.

The output of diode 76 connects the 6 volts from the battery cells 50 directly to one side of the light bulb 20 and directly to the D input 66 of the latching circuit 59. In addition, the 6 volts is connected by way of the motion detection switch 60, when closed, to the clock input 65 of the latching circuit 59 and by way of the reset switch 47, when closed, to the reset input 70 of the latching circuit 59.

It is noted that the clock input 65 of the latching circuit 59 is connected to ground via the resistor 74. This resistor 74 serves to connect the clock input 65 to ground (low level) when the motion detection switch 60 is open and raises the clock input 65 to a high voltage level to latch the latching circuit 59 when the motion detection switch 60 is initially closed. Also the reset input 70 of the latching circuit 59 is connected to ground via the resistor 75. This resistor 75 serves to connect the reset input 70 to ground (low level) when the reset switch 47 is open and raises the reset input 70 to a high voltage level to unlatch the latching circuit when the reset switch 47 is momentarily closed.

The latching circuit 59 is what is commonly known in the electronic field as a type D flipflop that is configured to operate as a latching circuit. The characteristics of a D flipflop are such that normally its Q output 67 is at ground (low level). However, when a positive going signal is received at its clock or trigger input 65, the high voltage level present at its D input 66 is transferred to its Q output 67 and latched, i.e., held at that high level. The latching circuit 59 then remains latched irrespective of how many times a positive going signal is received on its clock input 65 until a high level signal is applied on its reset input 70. The latching circuit 59 may be a CD4013BE integrated circuit unit marketed by RCA. Such a unit includes two D flipflops but since only ne is being used the other has all of its terminals grounded so as to be ineffective.

The control gate 72 contains a pair of n-p-n transistors 68 and 69 connected to form a Darlington pair configuration. Thus, as shown in FIG. 7, the input 73 of the control gate 72 which connects to the base terminal of transistor 68 is connected to the Q output 67 of the latching circuit 59, the emitter terminal of transistor 68 is connected to the base terminal of transistor 69, and the collectors of both transistors 68 and 69 are connected to the return side of the light bulb 20. In addition, the emitter of transistor 69 is connected to ground. The control gate 72 may be a ULN2003A integrated circuit unit marketed by Motorola. Such a unit includes seven Darlington pair circuits but since only one is being used, the remaining six all have their terminals grounded so as to be ineffective.

In the operation of the illuminating device 10 mounted on the wall 30 of a home, when the normally open motion detection switch 60 is vibrated or otherwise jolted during an earthquake, the first time the weighted free end 63 thereof touches the fixed contact 64, a positive going signal is applied to the clock input 65 of the latching circuit 59, triggering the latching circuit 59 and causing the high voltage level of 6 volts applied to its D input 66 to be transferred to its Q output 67 that is connected to the input 73 of the control gate 72. Hence, the high voltage level output 67 of latching circuit 59 is applied to the base of the n-p-n transistor 68, thus biasing it on and, in turn, biasing on the n-p-n transistor 69. The biasing on of the latter transistor 69 provides a ground path for the circuit of light bulb 20 and, therefore, turns on light bulb 20. In other words, when the Darlington pair transistors turn on they provide for completing the path of the electrical circuit for the light bulb 20 from the plus terminal of the series of battery cells 50, through the diode 76, through the light bulb 20, through the transistor 69 to ground, and back to the minus terminal of the battery cells 50.

Once the light bulb 20 has been turned on by the closing of the motion detection switch 60, any time that it is desired to turn off the light bulb 20, the normally-open reset switch 47 need only be momentarily closed by manually depressing push-button 25 on the front of the housing for device 10. This causes the pin 28 extending through the tubular guide 35, and having the adaptor 43 on the end thereof, to depress the spring loaded projection 48 on the contact of reset switch 47. The closing of reset switch 47 causes the 6 volts provided by the battery cells 50 to conduct current through the resistor 75 thus raising the voltage level at reset input 70 so as to unlatch the latching circuit 59. This causes the latched high voltage level at the Q output 67 to be terminated and causes the light bulb 20 to be turned off.

It should now be clearly understood that once latched by the signal provided by the closing of the motion detection switch 40, the Q output 67 of the latching circuit 59 remains latched at a high voltage level until the reset switch 47 is manually depressed. The resulting high voltage level applied to the reset input 70 overrides any signal levels at the D input 66 or the clock input 65 and causes the latching circuit to be unlatched. Once unlatched, the Q output 67 drops back to ground (low level).

It should be especially noted that the motion detection switch 60 is designed and calibrated such that when its weighted free end 63 is normally spaced away from the fixed contact 64 by a predetermined distance, such as the thickness of a conventional plastic credit card, for example, it takes a major earthquake, having an order of magnitude that is likely to cause a failure in the electrical service in the area, to cause the motion detection switch 60 to close.

While the invention has been concerned with a particular embodiment of the present invention, it is to be understood that many modifications and variations in the construction and arrangement thereof may be provided for without departing from the spirit and scope of the invention or sacrificing any of its advantages. The invention, is, therefore, considered as including all such possible modifications and variations coming within the legitimate and valid scope of the claims.

What is claimed is:

1. An illuminating device for use as a precautionary measure in a home located in an area subject to earthquakes, said device comprising:

a battery power supply;

a control gate;

a socket connected across said battery power supply by said control gate;

a light bulb in said socket;

a latching circuit connected to said battery power supply, said latching circuit having a trigger input and an output which normally has a low output voltage level thereon;

a normally-open motion detection switch connecting said battery power supply to the trigger input of said latching circuit;

said latching circuit being actuated by a signal supplied on the trigger input thereof when said motion detection switch is initially closed by the shaking of an earthquake into a latched state to provide a high voltage level on the output thereof;

said control gate operable in response to the high voltage level on the output of said latching circuit to turn on said light bulb; and a housing for enclosing said device, said housing having a front wall and a back wall;

a light compartment within said housing located opposite a window provided on the front wall thereof;

said light bulb held b_ said socket so as to extend into said light compartment; and means for detachably fastening the back wall of said housing to the wall of a home;

whereby when an earthquake occurs during the night hours that is severe enough to knock out the utility power for the home the housing enclosing the device can be readily removed from the wall of the home and used as a portable light source.

2. An illuminating device as defined in claim 1 including:

a reset input to said latching circuit;

a normally-open reset switch; and a push-button provided on the front wall of said housing and having a pin extending from the rear thereof which contacts said normally-open reset switch, said push-button operable when manually momentarily depressed to close said reset switch and provide a signal on the reset input to said latching circuit to actuate it into an unlatched state in which the output thereof is at a low voltage level, thereby turning off the light bulb.

3. An illuminating device as claimed in claim 1 wherein said control gate is a Darlington pair transistor circuit.

4. An illuminating device as claimed in claim 1 wherein said latching circuit is a D flipflop configured to function as a latching circuit.

5. An illuminating device as claimed in claim 1 wherein said normally-open motion detection switch comprises:

an arm formed of a thin strip of brass having a fixed end bent at a right angle to the arm and attached to a support, and an opposite free end portion wider than said arm; and a fixed contact attached to the support adjacent said free end portion;

said free end portion being normally spaced a predetermined distance away from said fixed contact to thereby control the severity of the shaking of an earthquake to which the illuminating device responds.

6. An illuminating device as claimed in claim 1 wherein said means for detachably fastening the back wall of said housing to the wall of a home includes securing fastening pads of a first woven structure on the back of the housing and securing correspondingly shaped fastening pads having a second woven structure in opposed relation on the wall of a home, said fastening pads of different woven structures interengaging when pressed together and separating when pulled apart.

7. An illuminating device comprising:

molded rectangular front and rear half housing sections, said front half housing section having a front wall;

said front half housing section including in the upper half thereof a light compartment having a back wall with a central circular opening thereon, and having on the front wall in the upper middle portion of the lower half thereof a circular hole with a molded rearwardly extending tubular guide, and having in the lower half thereof a block of foam cushion which has a hole therethrough through which the tubular guide extends, said block of foam cushion substantially filling the interior of the lower half of the front half housing section;

a push-button with a rearwardly extending pin inserted in said hole in the front wall so as to slidingly extend through and project beyond said tubular guide; and said rear half housing section having seated therein a rectangular printed circuit board which is coextensive with the interior thereof, said printed circuit board having components of an electrical circuit mounted thereon;

the components mounted on the upper half of said printed circuit board including:

a normally-open motion detection switch; and a forwardly extending elongated socket carrying a light bulb;

and the components mounted on the lower half of the printed circuit board including;

a normally-open reset switch with a spring loaded contact in the upper middle portion thereof; and a pair of vertically mounted battery cells on either side portion thereof;

whereby when said front and rear half housing sections are mated and secured together, the light bulb on the printed circuit board extends through the central circular opening on the back wall of the light compartment on the front half housing section, the end of the pin in the tubular guide on the front half housing section is adapted to engage the spring loaded contact on the normally-open reset switch on said printed circuit board; and the block of foam cushion located in the lower half of the front half housing section presses against the battery cells mounted on the side portions of the lower half of the printed circuit board to hold them securely in position during the jolting of the illuminating device by an earthquake.

8. An illuminating device comprising:

front and rear half housing sections, said front half housing section having a front wall;

said front half housing section including in one portion thereof opposite a window provided on the front wall thereof a light compartment having a back wall with a circular opening thereon, and including in an other portion thereof opposite a circular hole provided on the front wall thereof a rearwardly extending tubular guide;

a block of foam cushion positioned within said other portion of said front half housing section with said tubular guide extending through a hole provided in said block of foam cushion;

a push-button with a rearwardly extending pin inserted in said circular hole in the front wall so as to slidingly extend through and project beyond said tubular guide; and a printed circuit card seated in said rear half housing section, said printed circuit card having components of an electrical circuit mounted thereon, said components including:

a normally-open motion detection switch;

a socket carrying a light bulb;

a normally-open reset switch with a spring loaded contact; and battery cells;

whereby when said front and rear housing sections are mated and secured together, the light bulb extends through the circular opening on the back wall of the light compartment, the end of the pin in the tubular guide is positioned adjacent the spring loaded contact on the normally-open reset switch, and the block of foam cushion presses against the battery cells to hold them securely in position during the jolting of the illuminating device by an earthquake.

* * * * *